United States Patent [19]

Plevier

[11] Patent Number: 4,989,865

[45] Date of Patent: Feb. 5, 1991

[54] BATTING PRACTICE APPARATUS

[76] Inventor: Albert J. Plevier, 401 St. Clair Ave., Spring Lake, N.J. 07762

[21] Appl. No.: 508,830

[22] Filed: Apr. 13, 1990

[51] Int. Cl.[5] ..... A63B 69/40

[52] U.S. Cl. ..... 273/26 R

[58] Field of Search ..... 273/55 R, 55 A, 26 E, 273/26 A, 29 A; 272/78, 77

[56] References Cited

U.S. PATENT DOCUMENTS

| | | | |
|---|---|---|---|
| 1,708,638 | 4/1929 | Smith | 273/55 A |
| 2,466,954 | 4/1949 | King | 273/55 A |
| 2,765,170 | 10/1956 | Brown | 273/26 E |
| 2,921,976 | 11/1975 | Lane | 273/26 R |
| 3,716,235 | 2/1973 | Yerkie, Jr. | 273/26 E |
| 3,907,287 | 9/1975 | Fox et al. | 273/26 E |
| 4,185,821 | 1/1980 | Piccini | 273/26 R |
| 4,513,965 | 4/1985 | Aschermann | 273/26 R |
| 4,664,375 | 5/1987 | Tetreault | 273/26 E |

*Primary Examiner*—Theatrice Brown

*Attorney, Agent, or Firm*—Leon Gilden

[57] ABSTRACT

Apparatus including a vertical support including a tether line mounted to a top end of the support including a target cylinder mounted at a lower end of the flexible line. The target cylinder is formed as a semi-rigid polymeric tube including a support rod mounted therethrough. The cylinder includes a singular plurality of strips mounted medially of the surface of the cylinder for impact by an associated bat during a batting practice. Modifications of the invention include cylindrical weights adjustedly mounted within the cylinder to effect and exaggerate a spiral motion of a target cylinder subsequent to impact. Covering sheaths of a paper coated with a powdered coloring may optionally be utilized to indicate impact by the associated bat.

5 Claims, 4 Drawing Sheets

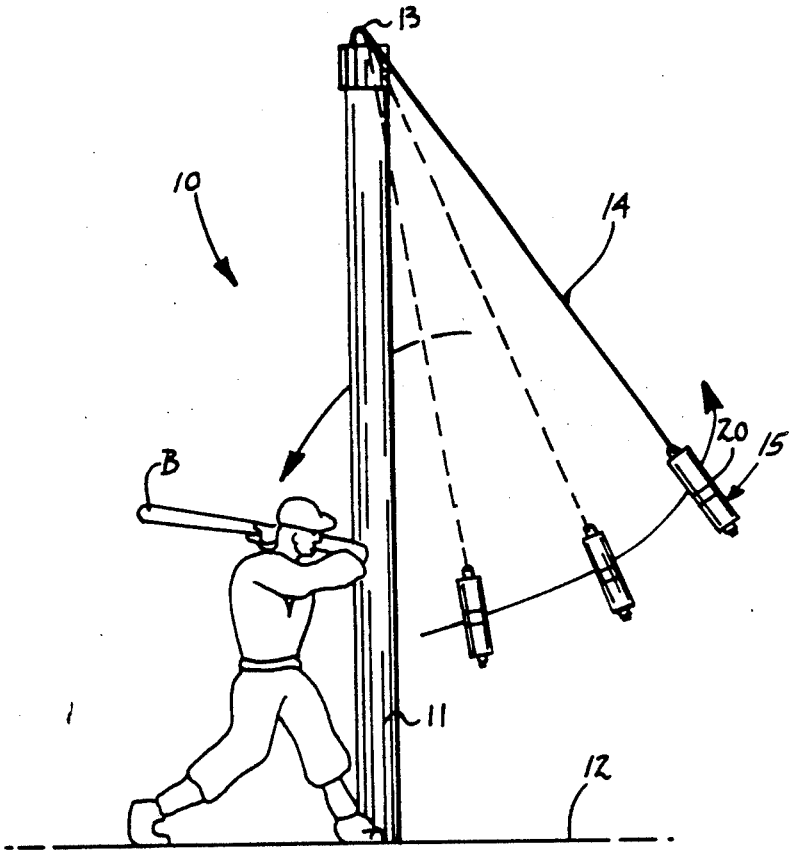
FIG 5
FIG 6
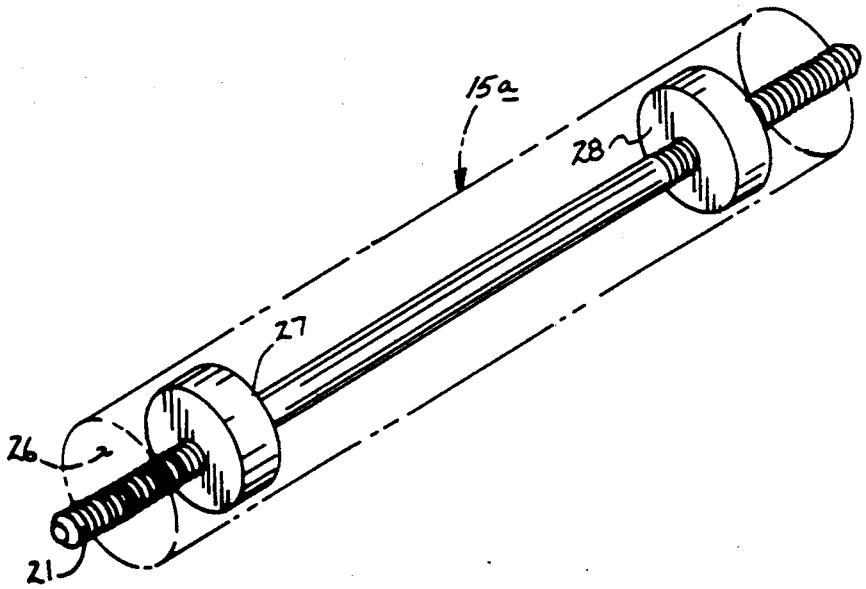

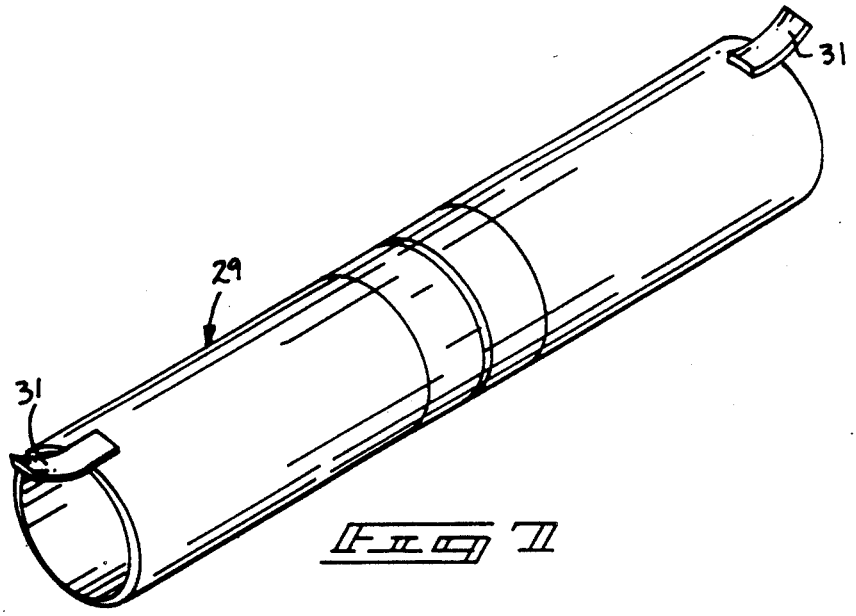
Fig 7
Fig 8
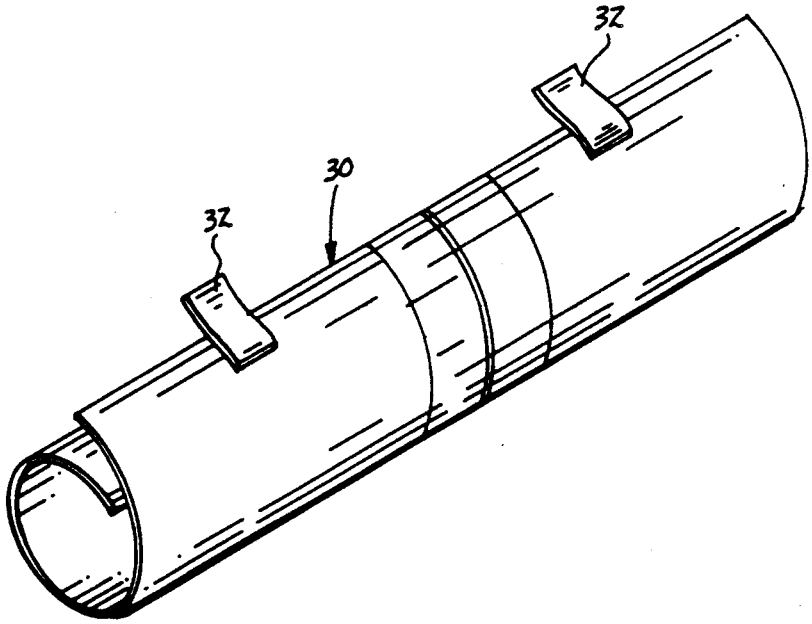

BATTING PRACTICE APPARATUS

BACKGROUND OF THE INVENTION

1. Field of the Invention

The field of the invention relates to batting practice apparatus, and more particularly pertains to a new and improved batting practice apparatus wherein the same utilizes a cylindrical target to effect a non-symmetrical arc of motion upon off center impact of the target by a bat.

2. Description of the Prior Art

During batting practice, a primary goal is to properly impact an associated target with a baseball bat. A cylindrical sphere upon impact provides a limited target as utilized in the game but does not provide visual illustration of where impact occurs when the spherical target is missed. The instant invention attempts to overcome disadvantage of the prior art by providing elongate cylinder providing an elongate target that will effect a non-symmetrical arc of trajectory upon not properly striking the target. Examples of the prior art include U.S. Pat. No. 4,050,694 to DOMROSKI setting forth a batting practice organization where a support rod includes an outwardly directed horizontal arm with a spherical baseball suspended from a forward end of the arm by a tether line.

U.S. Pat. No. 4,664,375 to TETREAULT sets forth a baseball practice device wherein a framework includes a plurality of spherical baseballs mounted underlying an adjustable stand relative to the baseballs.

U.S. Pat. No. 3,830,494 to BISKUP provides a spherical baseball mounted from a framework wherein the baseball is mounted to a loop end wherein the loop is displaceable along a support rod to indicate improper impact of the baseball by an individual.

U.S. Pat. No. 4,010,950 to VISOCKIS provides a baseball practice device wherein a horizontal support arm is selectively positionable about a plurality of supports mounted to a vertical wall surface.

U.S. Pat. No. 3,994,494 to KELLEY wherein a spherical baseball is suspended by a cord wherein the cord is of a variable length in association with a motor to vary the length of the cord as the ball moves through an arcuate path of travel towards the batter.

As such, it may be appreciated that there continues to be a need for a new and improved batting practice apparatus wherein the same addresses both the problems of ease of use as well as effectiveness in indicating improper impact of a target by an individual utilizing a baseball bat.

SUMMARY OF THE INVENTION

In view of the foregoing disadvantages inherent in the known types of batting practice apparatus present in the prior art, the present invention provides a new and improved batting practice apparatus wherein the same utilizes a cylindrical target in leu of a cylindrical ball to permit visual observation of improper impact of the target by a batter by imparting a non-symmetrical trajectory of arc to the target cylinder by improper impact of the cylinder by a batter utilizing a baseball bat. As such, the general purpose of the present invention, which will be described subsequently in greater detail, is to provide a new and improved batting practice apparatus which has all the advantages of the prior art batting practice apparatus and none of the disadvantages.

To attain this, the batting practice apparatus of the invention includes apparatus including a vertical support including a tether line mounted to a top end of the support including a target cylinder mounted at a lower end of the flexible line. The target cylinder is formed as a semi-rigid polymeric tube including a support rod mounted therethrough. The cylinder includes a singular plurality of strips mounted medially of the surface of the cylinder for impact by an associated bat during a batting practice. Modifications of the invention include cylindrical weights adjustedly mounted within the cylinder to effect and exaggerate a spiral motion of a target cylinder subsequent to impact. Covering sheaths of a paper coated with a powdered coloring may optionally be utilized to indicate impact by the associated bat.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved batting practice apparatus which has all the advantages of the prior art batting practice apparatus and none of the disadvantages.

It is another object of the present invention to provide a new and improved batting practice apparatus which may be easily and efficiently manufactured and marketed.

It is a further object of the present invention to provide a new and improved batting practice apparatus which is of a durable and reliable construction.

An even further object of the present invention is to provide a new and improved batting practice apparatus which is susceptible of a low cost of manufacture with regard to both materials and labor, and which accordingly is then susceptible of low prices of sale to the consuming public, thereby making such batting practice apparatuses economically available to the buying public.

Still yet another object of the present invention is to provide a new and improved batting practice apparatus which provides in the apparatuses and methods of the prior art some of the advantages thereof, while simultaneously overcoming some of the disadvantages normally associated therewith.

Still another object of the present invention is to provide a new and improved batting practice apparatus which may be compactly stored when not being utilized.

Yet another object of the present invention is to provide a new and improved batting practice apparatus wherein the same utilizes a cylindrical target device wherein the target device will follow a non-symmetrical arc of trajectory upon proper impact of the device to visually illustrate an improper swing by an individual utilizing a baseball bat.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an orthographic view taken in elevation of the instant invention.

FIG. 6 is an isometric illustration partially in phantom of a modified target cylinder utilized by the instant invention.

FIG. 7 is an isometric illustration of a covering layer utilized by the instant invention.

FIG. 8 is an isometric illustration of a further covering layer utilized by the instant invention.

DESCRIPTION OF THE PREFERRED EMBODIMENT

Figure 1:
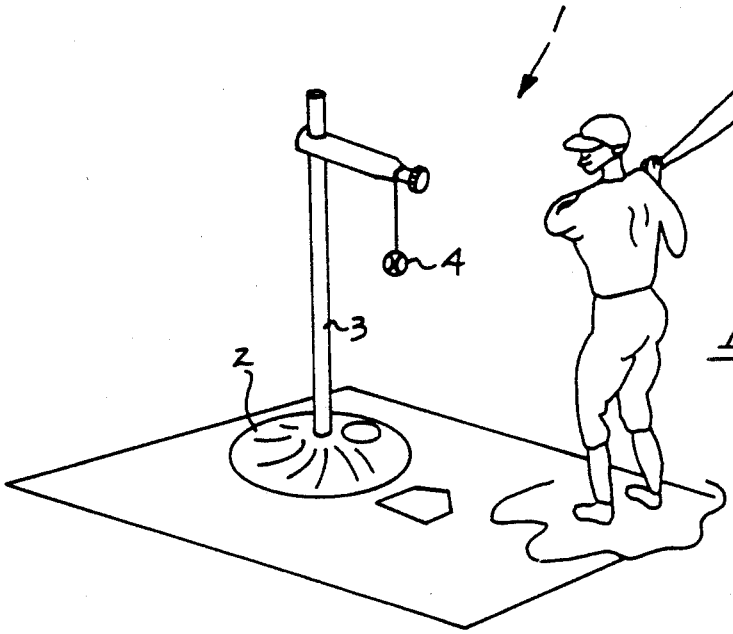
FIG 1 PRIOR ART
FIG. 1 is an isometric illustration of a prior art batting practice apparatus.

With reference now to the drawings, and in particular to FIGS. 1 to 8 thereof, a new and improved batting practice apparatus embodying the principles and concepts of the present invention and generally designated by the reference numeral 10 will be described.

Figure 2:
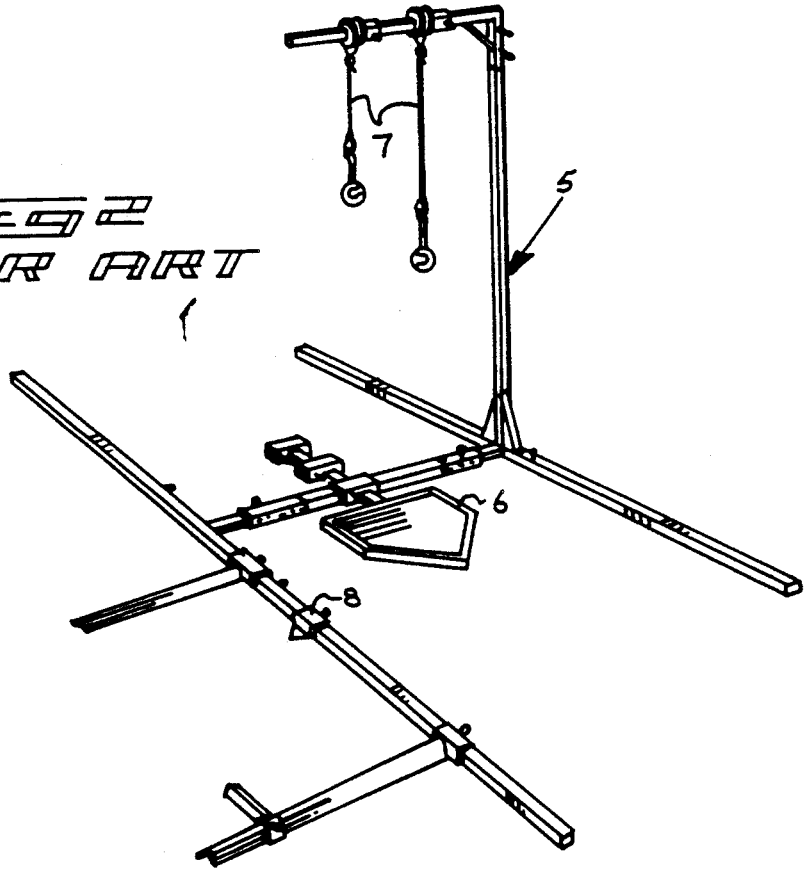
FIG 2 PRIOR ART
FIG. 2 is an isometric illustration of a further prior art batting practice apparatus.
Figures 3, 4:
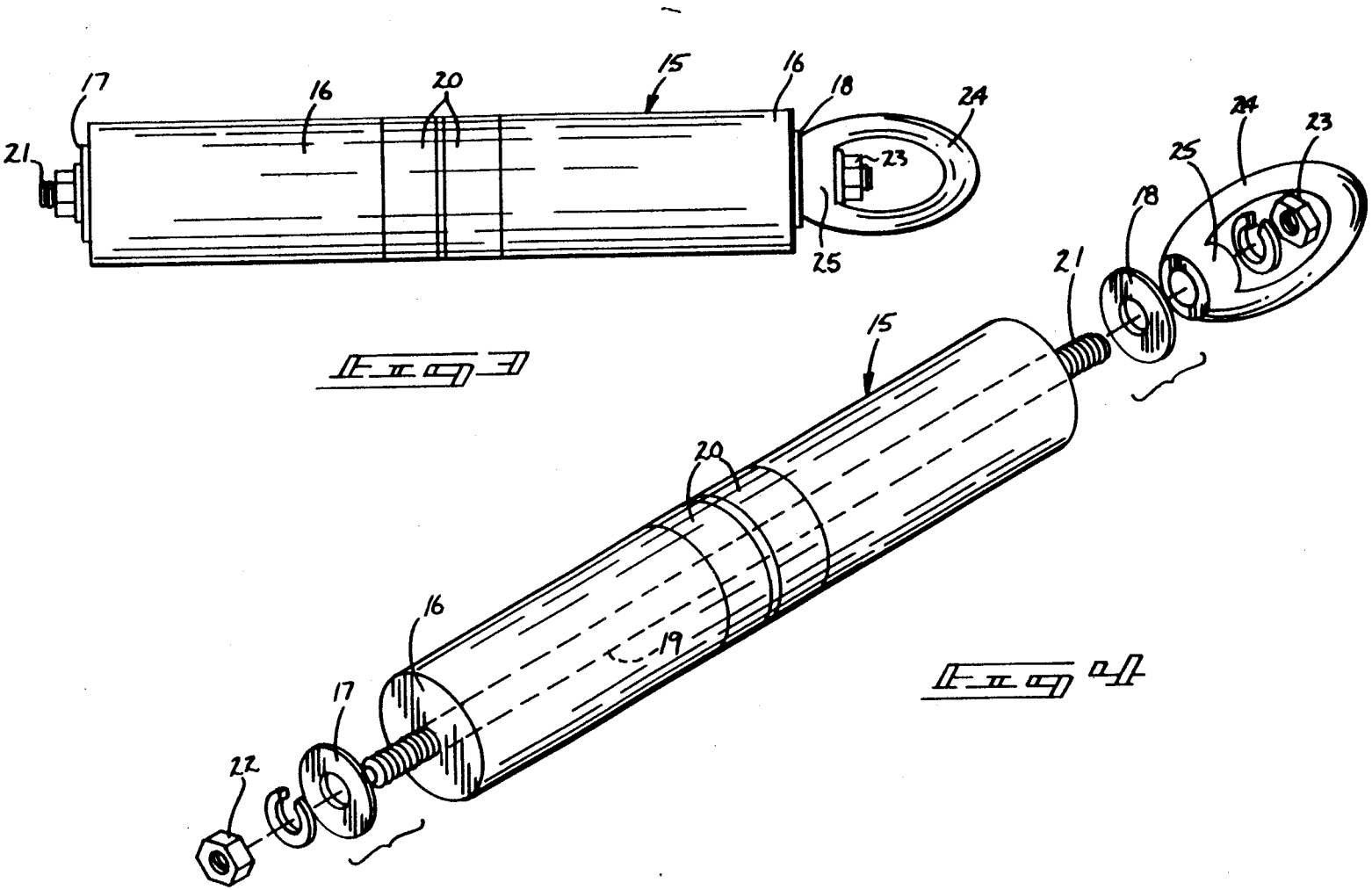
FIG. 3 is an orthographic side view taken in elevation of a target cylinder utilized by the instant invention.
FIG. 4 is an isometric illustration somewhat exploded of the target cylinder utilized by the instant invention.

FIG. 1 illustrates a prior art batting practice apparatus 1 wherein a support stand 2 mounts a vertical post 3 wherein a horizontal arm suspends a spherical baseball 4 therefrom. FIG. 2 illustrates a further prior art device 5 wherein a repositionable "home-plate" 6 is positionable relative to the framework for positioning the plate relative to a plurality of targets 7. The framework includes an adjustable indicator member 8 for varying positioning or stand of the individual during a batting practice procedure.

More specifically, the batting practice apparatus 10 of the instant invention essentially comprises a vertical support post 11 mounted to a horizontal support surface 12 in a generally orthogonal relationship. An elongate flexible tether line 14 of a predetermined length less than that defined by the post 11 is mounted to a ring member 13 that in turn is either fixedly or pivotally mounted to an upper end of the post 11. An elongate longitudinally aligned target cylinder 15 is mounted to a lower free terminal end of the tether line 14. The target cylinder 15 is formed in a semi-rigid polymeric cylinder 16 of a predetermined diameter. A bottom rigid washer 17 is mounted to a lower end surface of the cylinder 16 with a top rigid washer 18 mounted to a top end surface of the cylinder 18. A central tubular aperture 19 is coaxially directed through the cylinder 16 with a threaded rod 21 of a predetermined length greater than the length of the cylinder 16 received through the central tubular aperture 19. The rod 21 extends forwardly of each end surface of the cylinder 16. A respective lower and upper fastener member 22 and 23 is mounted to the rod to secure the rod to the lower end surface against the bottom washer 17 and to fasten a support boss 25 to the top washer 18. The support boss 25 includes a support aperture directed coaxially therethrough and aligned with an elliptical loop 24 integrally mounted overlying the support boss 25. A single or plurality of fiberglass target tape members 20 are mounted medially about the exterior surface of the target cylinder 15 to provide a visible target for attempted impact by a batter utilizing a conventional baseball bat B as illustrated in FIG. 5 for example.

FIG. 6 illustrates a modified target cylinder 15 defining a central cylindrical opening 26 of a somewhat enlarged diameter wherein the threaded rod 21 receives a first and second respective cylindrical weight 27 and 28 received within the target cylinder 15*a*. The first and second cylindrical weights 27 and 28 respectively are rotatably mounted for adjustment along the respective upper and lower ends of the threaded rod 21 to permit enhanced off center displacement of the center of gravity of the target cylinder 15 to enhance a wobbling effect of the cylinder during impact as well as providing enhance resistance to impact by a batter. FIGS. 7 and 8 illustrate the use of indicator tubes for selective and temporary securement about the target cylinder 15 or 15*a*. The paper tube 29 and the paper sheet 30 are each impregnated with a powdered colored pigment whereupon impact by the bat B, the pigment is displaced for enhanced visual indication along the target cylinder as to the exact positioning of the baseball bat during its impact with the target cylinder. The paper tube 29 includes a plurality of first tape members 31 mounted to opposed ends of the tube for securement to the cylinder while the sheet 30 includes second tape members 32 mounted to an edge end of the sheet for securement about itself and for frictional surrounding engagement to the tube 15 or 15*a* in use.

As to the manner of usage and operation of the instant invention, the same should be apparent from the above disclosure and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A batting practice apparatus comprising, an elongate vertical support post, the support post including an upper post end, and an elongate flexible tether line, the flexible tether line mounted to the post end at an upper end of the flexible tether line and wherein a lower free end of the tether line is mounted to an elongate target cylinder, the target cylinder including a cylinder loop fixedly secured to an upper terminal end of the target cylinder with the loop mounted to the free end of the tether line, and wherein the target cylinder is formed of a polymeric semi-rigid material, and includes an elongate aperture coaxially and coextensively directed through the cylinder, and an elongate rod directed through the aperture, the elongate rod mounted to the loop at an upper end of the rod, and a lower end of the rod projecting exteriorly of a lower end of the cylinder including lower fastening means mounted to the rod to secure the rod within the aperture, and wherein the target cylinder includes at least one fiberglass tape member mounted medially of the cylinder about an exterior surface of the cylinder orthogonally oriented relative to the elongate rod.

2. Apparatus as set forth in claim 1 wherein the fiberglass tape is formed of a contrasting color relative to the target cylinder to enhance visibility of the fiberglass tape relative to the cylinder.

3. Apparatus as set forth in claim 2 wherein the through-extending aperture includes a first cylindrical weight mounted within the aperture vertically adjustable relative to the rod, and a second cylindrical weight mounted within the aperture vertically adjustable relative to the rod wherein the first and second cylindrical weights are contained within the cylinder.

4. Apparatus as set forth in claim 3 wherein the loop is formed as an elliptical loop including a base integrally mounted to a lower end of the loop, the base includes a through extending base aperture, the base aperture coaxially aligned with the loop, and the rod received through the base aperture.

5. Apparatus as set forth in claim 4 further including a paper cylinder, the paper cylinder complementarily receiving the target cylinder therewithin, the paper cylinder impregnated with a colored pigment to provide indication of impact with a baseball bat during a batting practice procedure, and the paper cylinder including an upper and lower tape member mounted at opposed terminal ends of the paper cylinder to secure the paper cylinder to opposed end surfaces of the target cylinder.

* * * * *